US008476997B2

(12) United States Patent
Hrnjak et al.

(10) Patent No.: US 8,476,997 B2
(45) Date of Patent: Jul. 2, 2013

(54) SOFT-START SYSTEMS AND METHODS FOR VEHICLE STARTERS

(75) Inventors: Aleksandar Hrnjak, Windsor (CA); James David Plenzler, Toledo, OH (US); Robert David Hall, Berkey, OH (US); Clive Harley, Ann Arbor, MI (US)

(73) Assignee: Prestolite Electric, Inc., Plymouth, MI (US)

( * ) Notice: Subject to any disclaimer, the term of this patent is extended or adjusted under 35 U.S.C. 154(b) by 0 days.

(21) Appl. No.: 13/224,535

(22) Filed: Sep. 2, 2011

(65) Prior Publication Data

US 2012/0139677 A1 Jun. 7, 2012

Related U.S. Application Data

(60) Provisional application No. 61/379,428, filed on Sep. 2, 2010.

(51) Int. Cl.
*H01H 67/02* (2006.01)

(52) U.S. Cl.
USPC ..... 335/126; 335/131

(58) Field of Classification Search
USPC ..... 335/68, 126, 127, 131
See application file for complete search history.

(56) References Cited

U.S. PATENT DOCUMENTS

| | | | | |
|---|---|---|---|---|
| 5,892,421 | A * | 4/1999 | Matsushima | 335/126 |
| 5,892,422 | A | 4/1999 | Montaigu | |
| 6,759,756 | B2 * | 7/2004 | Shiga et al. | 290/38 R |
| 7,034,643 | B1 * | 4/2006 | Kusumoto et al. | 335/126 |
| 7,116,196 | B1 * | 10/2006 | Hirabayashi | 335/282 |
| 7,659,801 | B2 * | 2/2010 | Kusumoto et al. | 335/126 |
| 7,973,623 | B2 * | 7/2011 | Andoh | 335/126 |
| 8,106,731 | B2 * | 1/2012 | Yamauchi et al. | 335/126 |
| 8,248,193 | B2 * | 8/2012 | Kaneda et al. | 335/126 |
| 2002/0053961 | A1 | 5/2002 | Kajino | |
| 2002/0158519 | A1 | 10/2002 | Fulton | |
| 2004/0012902 | A1 * | 1/2004 | Ikeda | 361/23 |
| 2007/0139146 | A1 * | 6/2007 | Kusumoto et al. | 335/131 |
| 2009/0002105 | A1 | 1/2009 | Bradfield | |
| 2010/0033066 | A1 | 2/2010 | Murata | |

OTHER PUBLICATIONS

Patent Cooperation Treaty, Notification of Transmittal of International Search Report and the Written Opinion of the International Searching Authority, or the Declaration, in International application No. PCT/US2011/050312, dated Dec. 23, 2011. (9 pages).

* cited by examiner

*Primary Examiner* — Alexander Talpalatski
(74) *Attorney, Agent, or Firm* — McAndrews, Held & Malloy, Ltd.

(57) ABSTRACT

Soft-start systems and methods for vehicle starters are provided. Embodiments provide a solenoid including: a first coil that receives power when an ignition switch is closed; a first plunger actuated when the first coil receives power; a first terminal configured to be abutted by a contact bar of the first plunger; a second coil that receives power when the contact bar of the first plunger abuts the first terminal; a second plunger actuated when the second coil receives power; and a second terminal configured to be abutted by a contact bar of the second plunger. Such a solenoid is configured to provide power at a first level to an attached motor when the contact bar of the first plunger abuts the first terminal and at a second level that is higher than the first level when the contact bar of the second plunger abuts the second terminal.

2 Claims, 6 Drawing Sheets

SOFT-START SYSTEMS AND METHODS FOR VEHICLE STARTERS

BACKGROUND OF THE INVENTION

During vehicle start-up, it has been found desirable to run the motor initially at reduced power. This practice is referred to as a "soft-start." One advantage of a soft start is to run the motor initially with reduced torque in the powertrain, which can allow the pinion to fully engage the ring gear prior to the motor being run at full power. In order to achieve a soft-start, present vehicle motors include a relay between the ignition switch and the solenoid that provides operating current to the motor. Examples of patent references that describe such configurations include U.S. Pat. Nos. 5,475,270, 5,892,422 and U.S. App. Pub. No. 2009/0002105.

A schematic of a prior art vehicle start system 100 that includes a relay 102 between the ignition switch 104 and the solenoid 106 is depicted in FIG. 1. The system 100 also includes a battery 108 and motor 110. In operation, when a vehicle operator turns the key, the ignition switch 104 allows power (about 1-5 amps, for example) to flow from battery 108 to relay 102. Relay 102 then allows power (about 250 amps, for example) to flow from battery 108 to solenoid 106. Energizing solenoid 106 allows power (about 250 amps, for example) to flow to motor 110 and begins solenoid plunger moving toward contacts 114 and 116. When solenoid plunger 112 abuts contacts 114 and 116, higher power (about 2000 amps, for example) flows from battery 108 to motor 110 via solenoid 106. The initial period when the motor is supplied lower power (about 250 amps, for example) provides a soft start.

However, the extra relay takes up space, is a potential point of failure and adds cost to the vehicle starting system.

Thus, there is a need for improved soft-start systems and methods for vehicles.

SUMMARY OF THE INVENTION

Embodiments of the present technology provide improved soft-start systems and methods.

BRIEF DESCRIPTION OF THE DRAWING(S)

Figure 1:
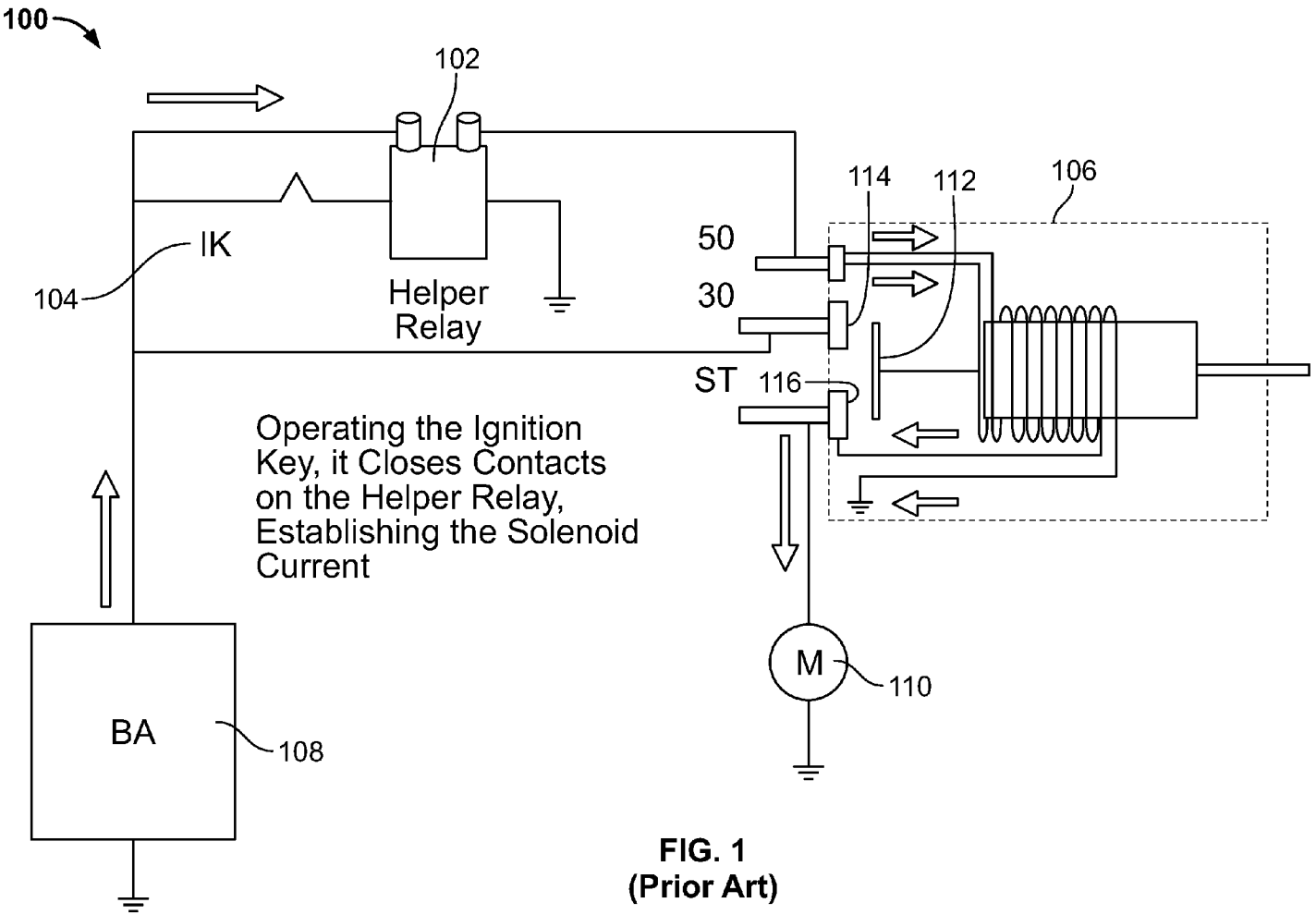
FIG. 1 (Prior Art)
FIG. 1 is a schematic of a prior art vehicle start system.

The foregoing summary, as well as the following detailed description of embodiments of the present invention, will be better understood when read in conjunction with the appended drawings. For the purpose of illustrating the invention, certain embodiments are shown in the drawings. It should be understood, however, that the present invention is not limited to the arrangements and instrumentalities shown in the attached drawings.

DETAILED DESCRIPTION OF PREFERRED EMBODIMENT(S)

Embodiments of the present technology provide improved soft-start systems and methods. In the figures, like elements are identified with like indicators.

FIG. 1 is a schematic of a prior art vehicle start system 100 that is described in the background section.

Figure 2:
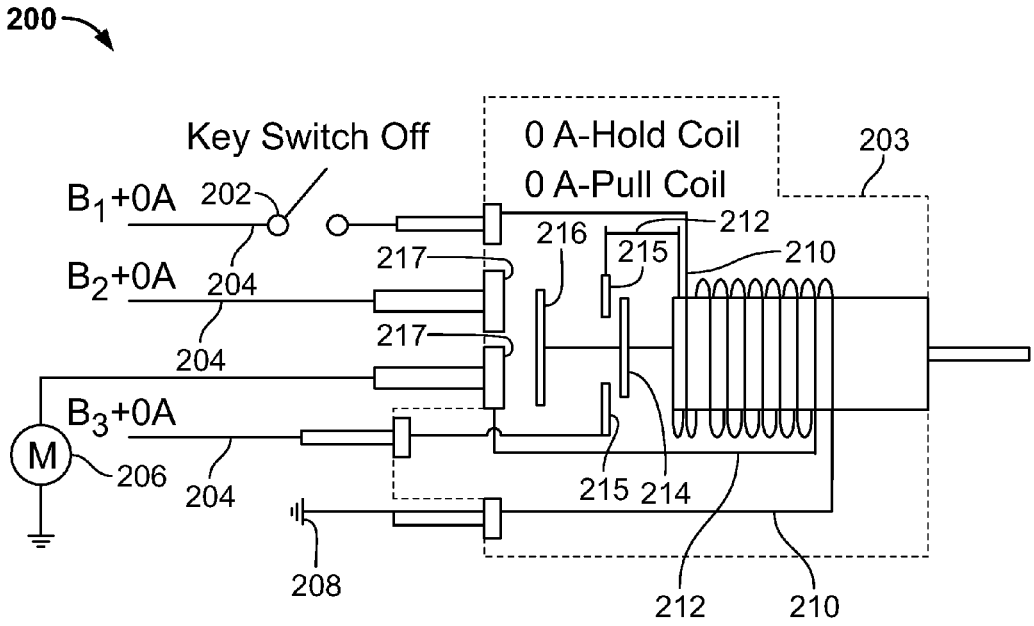
FIG. 2 is a schematic of a vehicle start system used in accordance with an embodiment of the present technology in a first state.

FIG. 2 is a schematic of a vehicle start system 200 used in accordance with an embodiment of the present technology in a first state. The vehicle start system 200 includes key switch 202, solenoid 203, battery 204, motor 206 and ground 208. Solenoid 203 includes hold coil 210, pull coil 212, first plunger with contact bar 214, first terminal 215, second plunger with contact bar 216, and second terminal 217. In the first state depicted in FIG. 2, key switch 202 is open/off such that: (1) power does not flow to solenoid 203 from battery 204 via connection $B_1$; (2) power does not flow to solenoid 203 from battery 204 via connection $B_2$, and (3) power does not flow to solenoid 203 from battery 204 via connection $B_3$. This is the state of the vehicle start system 200 when motor 206 is not running and vehicle ignition has not been triggered, for example, by an operator of the vehicle turning a key in the ignition.

Figure 3:
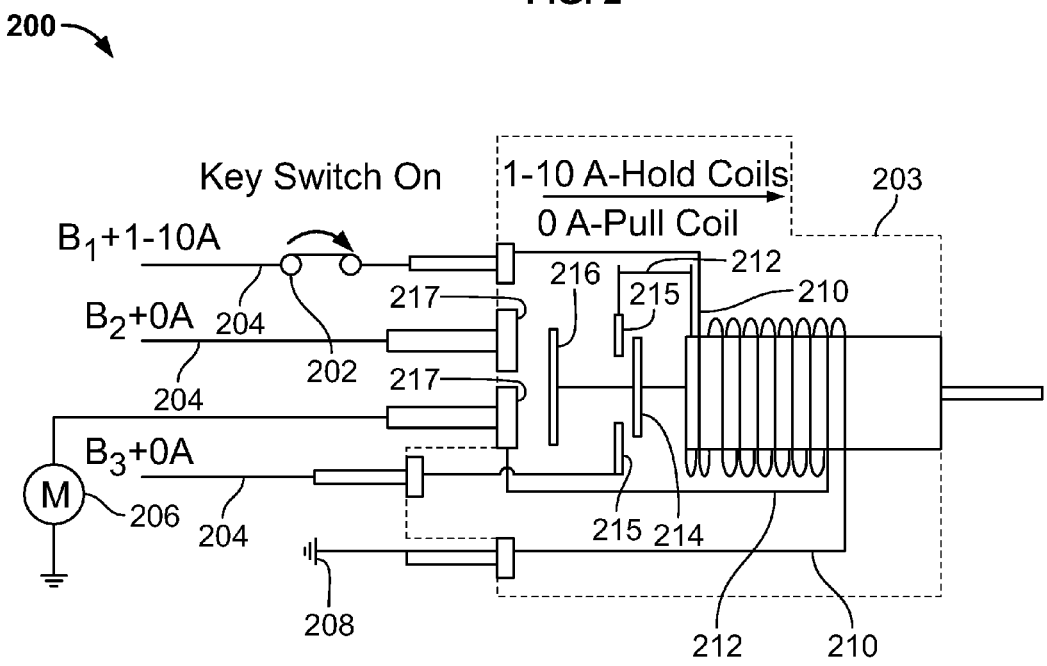
FIG. 3 is a schematic of the vehicle start system of FIG. 2 in a second state.

FIG. 3 is a schematic of the vehicle start system 200 in a second state. This is the state of the vehicle start system 200 immediately after a vehicle ignition is triggered, for example, by an operator of the vehicle turning a key in the ignition. In the second state depicted in FIG. 3, key switch 202 is closed/on such that power (about 1-10 amps, for example) is allowed to flow to solenoid 203 from battery 204 via connection $B_1$. Supplying power to solenoid 203 via connection $B_1$ energizes hold coil 210 causing first plunger with contact bar 214 to move laterally toward first terminal 215. Motor 206 is not running in this state.

Figure 4:
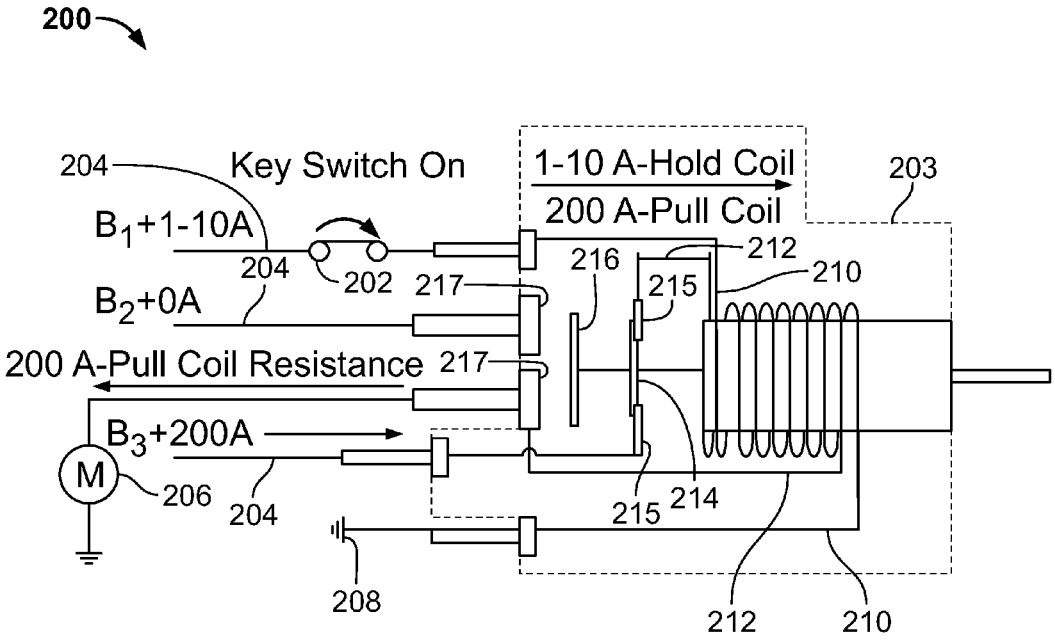
FIG. 4 is a schematic of the vehicle start system of FIG. 2 in a third state.

FIG. 4 is a schematic of the vehicle start system 200 in a third state. This is the state of the vehicle start system 200 immediately after contact bar 214 of first plunger abuts first terminal 215. Abutting contact bar 214 to first terminal 215 energizes pull coil 212 via connection $B_3$, thereby allowing power (about 200 amps, for example) to flow to motor 206 from battery 204 via solenoid 203 and connection $B_3$, and causing second plunger with contact bar 216 to move laterally toward second terminal 217. Motor 206 is running in this state at lower power (about 200 amps, for example) providing a soft-start.

Figure 5:
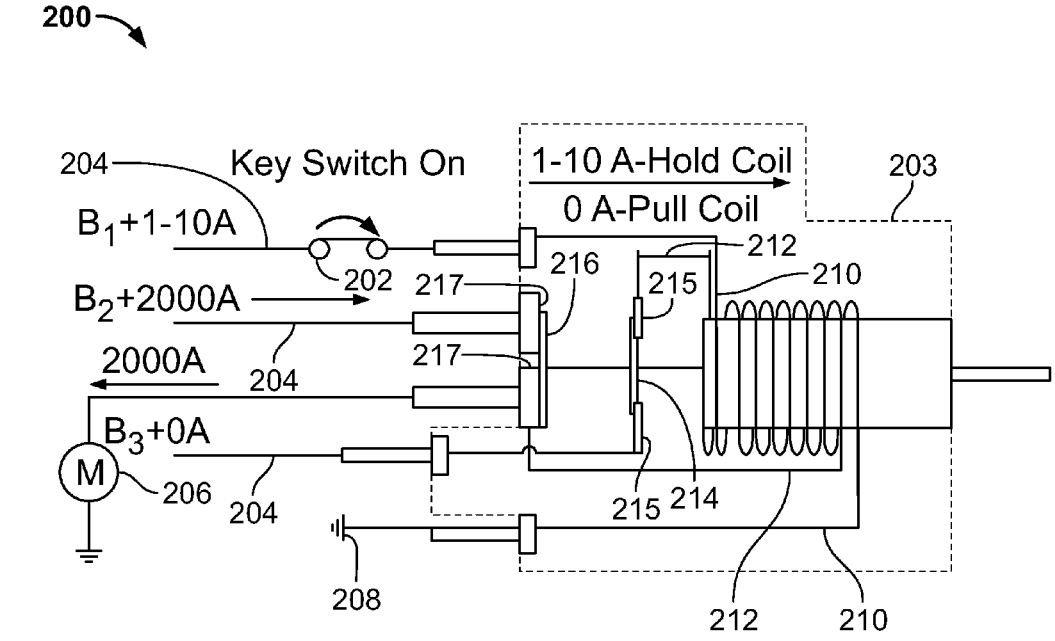
FIG. 5 is a schematic of the vehicle start system of FIG. 2 in a fourth state.

FIG. 5 is a schematic of the vehicle start system 200 in a fourth state. This is the state of the vehicle start system 200 immediately after second plunger with contact bar 216 abuts second terminal 217. Abutting contact bar 216 of second plunger to second terminal 217 allows higher power (about 2000 amps, for example) to flow to motor 206 from battery 204 via solenoid 203 and connection $B_2$. Motor 206 is running in this state at higher power (about 2000 amps, for example).

When the motor is stopped, for example by an operator of the vehicle turning a key in the ignition, the vehicle start system 200 will return to the first state depicted in FIG. 2.

Figure 6:
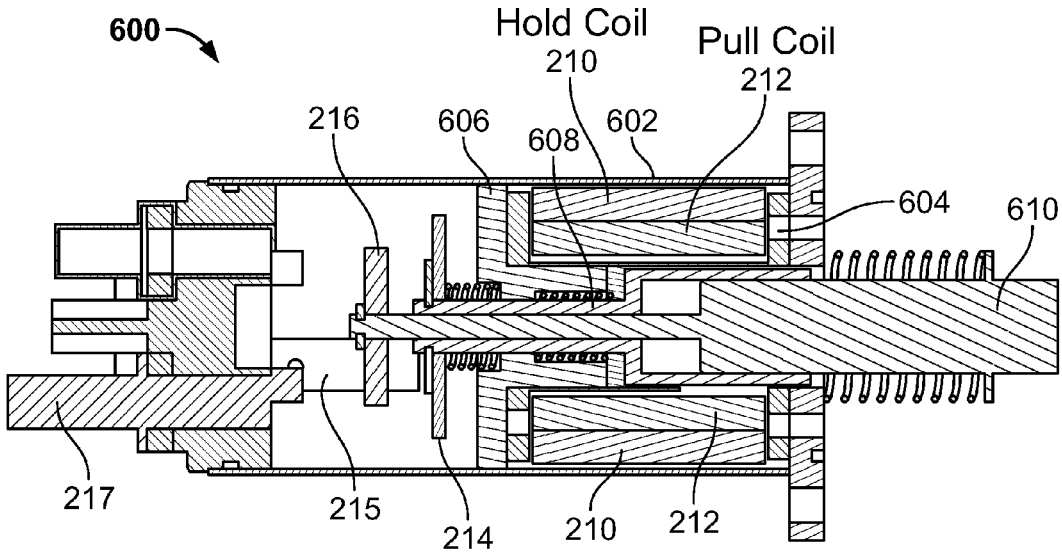
FIG. 6 depicts a side-sectional view of a solenoid used in accordance with an embodiment of the present technology.
Figure 7:
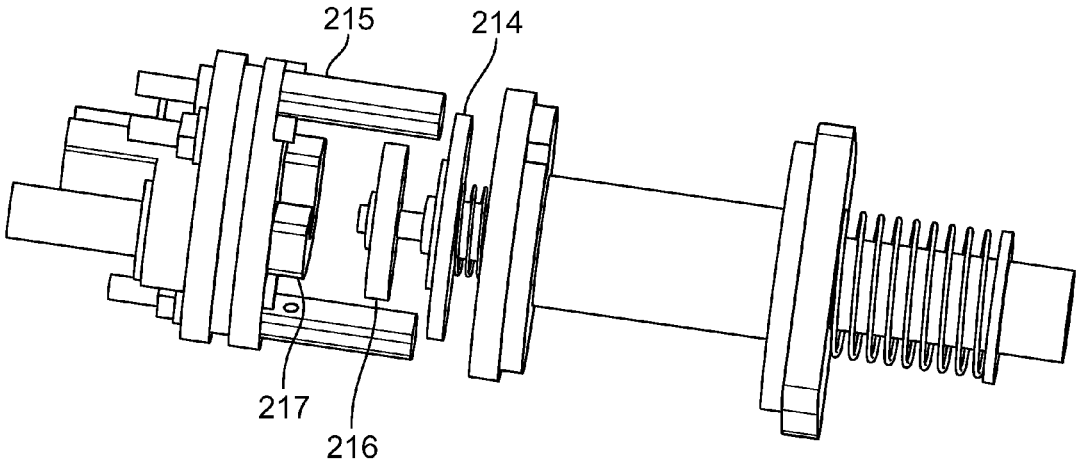
FIG. 7 depicts a perspective view of the solenoid of FIG. 6.

FIG. 6 depicts a side-sectional view of a solenoid 600 used in accordance with an embodiment of the present technology. Solenoid 600 includes the elements of solenoid 203 described above in connection with FIGS. 2-5. Solenoid 600 also includes body 602, bobbin 604 and anvil 606, and depicts the first plunger 608 with contact bar 214 and the second plunger 610 with contact bar 216. FIG. 7 depicts a perspective view of the solenoid of FIG. 6.

Figure 8:
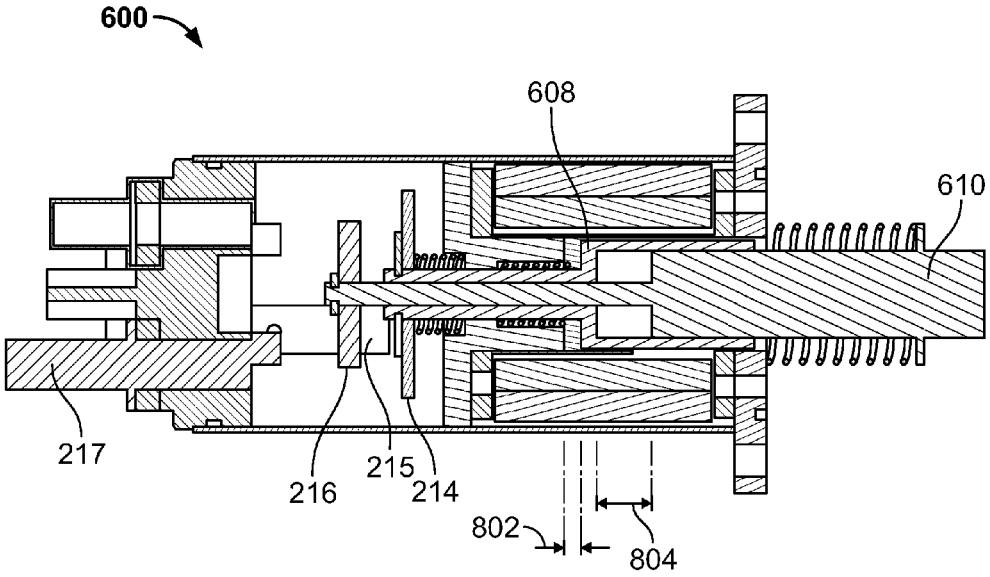
FIG. 8 depicts a side-sectional view of the solenoid of FIG. 6.
Figure 9:
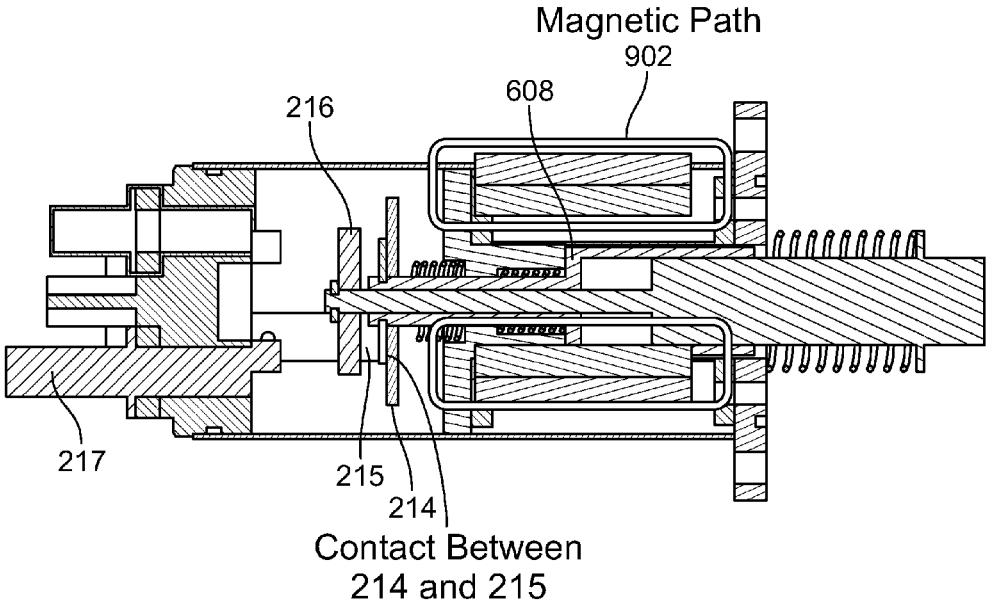
FIG. 9 depicts a side-sectional view of the solenoid of FIG. 6.
Figure 10:
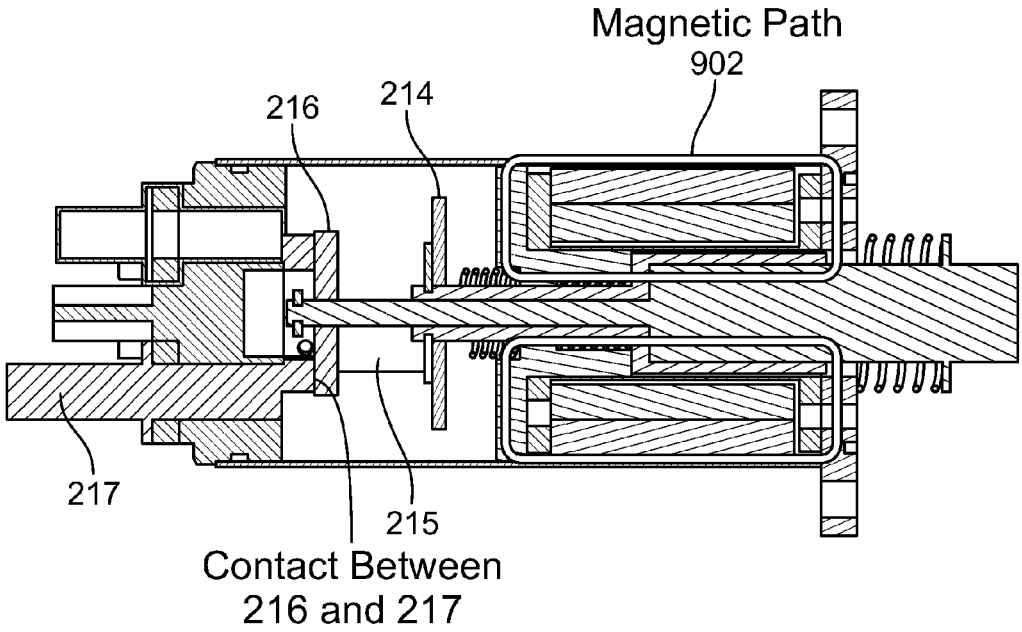
FIG. 10 depicts a side-sectional view of the solenoid of FIG. 6.

FIGS. 8-10 depict side-sectional views of the solenoid of FIG. 6. FIG. 8 depicts solenoid 600 in the first state described above in connection with FIG. 2. In the first state, there is a first gap 802 that first plunger 608 with contact bar 214 can traverse prior to contact bar abutting first terminal 215. There is also a second gap 804 that second plunger 610 with contact bar 216 can traverse prior to contact bar abutting first terminal 217.

FIG. 9 depicts solenoid 600 in the third state described above in connection with FIG. 4. In the third state, first plunger 608 with contact bar 214 abuts first terminal 215, but second plunger 610 with contact bar 216 does not abut second terminal 217. In this state, an attached motor would be running at lower power (about 200 amps, for example) providing a soft-start.

FIG. 10 depicts solenoid 600 in the fourth state described above in connection with FIG. 5. In the fourth state, first plunger 608 with contact bar 214 abuts first terminal 215, and second plunger 610 with contact bar 216 abuts second terminal 217. In this state, an attached motor would be running at higher power (about 2000 amps, for example).

FIGS. 9-10 also depict the magnetic path 902 of the solenoid coils 210, 212.

In operation, a solenoid and/or vehicle start system as described herein can provide a soft-start for a motor without requiring an additional relay. Certain embodiments of the present invention include methods of starting an engine using a solenoid and/or vehicle start system as described herein. Certain embodiments of the present invention include methods of making a solenoid and/or vehicle start system as described herein.

Certain embodiments of the inventive solenoids and/or vehicle start systems can provide for: (1) improved use of space by eliminating the additional relay; (2) removal of a potential point of failure; and/or (3) lower cost.

While particular elements, embodiments and applications of the present invention have been shown and described, it will be understood that the invention is not limited thereto since modifications can be made by those skilled in the art without departing from the scope of the present disclosure, particularly in light of the foregoing teachings.

What is claimed is:

1. A solenoid for use in a vehicle starting system comprising:

a first coil configured to receive power when an ignition switch is closed;

a first plunger comprising a contact bar operatively connected to the first coil such that the first plunger is actuated when the first coil receives power;

a first terminal configured to be abutted by the contact bar of the first plunger after the first plunger is actuated;

a second coil configured to receive power after the contact bar of the first plunger abuts the first terminal;

a second plunger comprising a contact bar operatively connected to the second coil such that the second plunger is actuated when the second coil receives power; and a second terminal configured to be abutted by the contact bar of the second plunger after the second plunger is actuated, wherein:

the solenoid is configured to provide power at a first level to an attached motor when the contact bar of the first plunger abuts the first terminal and the contact bar of the second plunger does not abut the second terminal, the solenoid is configured to provide power to an attached motor at a second level that is higher than the first level when the contact bar of the second plunger abuts the second terminal, the first coil is wound around the first plunger and the second plunger, and the second coil is wound around the first plunger and the second plunger.

2. A method of starting a vehicle using a solenoid comprising:

providing power to a first coil of a solenoid when an ignition switch is closed;

actuating a first plunger comprising a contact bar operatively connected to the first coil when the first coil receives power;

abutting the contact bar of the first plunger with a first terminal;

providing power to a second coil after the contact bar of the first plunger abuts the first terminal;

providing power to a motor at a first level when the contact bar of the first plunger abuts the first terminal;

actuating a second plunger comprising a contact bar operatively connected to the second coil when the second coil receives power;

abutting the contact bar of the second plunger with a second terminal; and providing power to a motor at a second level that is higher than the first level when the contact bar of the second plunger abuts the second terminal, wherein:

the first coil is wound around the first plunger and the second plunger, and the second coil is wound around the first plunger and the second plunger.

* * * * *